US011858693B2

(12) United States Patent
Wihlborg et al.

(10) Patent No.: US 11,858,693 B2
(45) Date of Patent: Jan. 2, 2024

(54) HINGED ZIPPER ASSEMBLY OF A RESEALABLE ENCLOSURE

(71) Applicant: Illinois Tool Works Inc., Glenview, IL (US)

(72) Inventors: Lars Wihlborg, Stratford, CT (US); Jose Septien, Naperville, CT (US); Clifton Howell, Elburn, IL (US); Marion Johnson, Hoffman Estates, IL (US); Marco Aguilar, Elgin, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/404,864

(22) Filed: Aug. 17, 2021

(65) Prior Publication Data

US 2022/0055799 A1 Feb. 24, 2022

Related U.S. Application Data

(60) Provisional application No. 63/067,608, filed on Aug. 19, 2020.

(51) Int. Cl.
*B65D 33/25* (2006.01)
*A44B 19/10* (2006.01)

(52) U.S. Cl.
CPC ..... *B65D 33/2541* (2013.01); *A44B 19/10* (2013.01)

(58) Field of Classification Search
CPC ..... B65D 33/2541; A44B 19/10
USPC ..... 383/63, 64
See application file for complete search history.

(56) References Cited

U.S. PATENT DOCUMENTS

| | | | |
|---|---|---|---|
| 3,119,689 | A | 1/1964 | Saia |
| 3,122,807 | A | 3/1964 | Ausnit |
| 3,160,934 | A | 12/1964 | Ausnit |
| 3,203,062 | A | 8/1965 | Ausnit |
| 3,230,593 | A | 1/1966 | Herz |

(Continued)

FOREIGN PATENT DOCUMENTS

| | | | |
|---|---|---|---|
| EP | 3360815 B1 | | 1/2020 |
| JP | 2011072396 A | * | 4/2011 |

OTHER PUBLICATIONS

International Search Report and Written Opinion dated Nov. 18, 2021 for corresponding application No. PCT/US2021/046402 (12 pages).

(Continued)

*Primary Examiner* — Jes F Pascua
(74) *Attorney, Agent, or Firm* — The Small Patent Law Group LLC; Christopher R. Carroll

(57) ABSTRACT

A hinged zipper assembly includes first and second zipper members each having a facing side, an opposite side, an upper edge, and an opposite lower edge. Each of the zipper members has a profile protrusion that extends from the facing sides and are located between the upper and lower edges. The profile protrusions mesh with each other to interlock with each other. A living hinge is formed in the first zipper member and/or the second zipper member between the lower edge and the profile protrusion. The zipper members are formed with flanges that extend from the lower edges. The flanges are configured to be affixed to panels of an enclosure that is closed by meshing of the profile protrusions of the first and second zipper members with each other.

14 Claims, 8 Drawing Sheets

(56) References Cited

U.S. PATENT DOCUMENTS

| | | | | | |
|---|---|---|---|---|---|
| 3,416,199 | A | * | 12/1968 | Imamura | B65D 33/2541 24/585.12 |
| 3,959,856 | A | * | 6/1976 | Ausnit | B65D 33/2541 24/399 |
| 4,268,938 | A | * | 5/1981 | Walchli | B65D 33/2541 24/DIG. 42 |
| 4,710,968 | A | * | 12/1987 | Borchardt | B65D 33/2541 24/339 |
| 5,774,955 | A | * | 7/1998 | Borchardt | B65D 33/255 24/584.1 |
| 6,047,450 | A | | 4/2000 | Machacek et al. | |
| 6,182,337 | B1 | | 2/2001 | Machacek et al. | |
| 6,721,999 | B2 | | 4/2004 | Meager | |
| 7,097,359 | B2 | | 8/2006 | Plourde et al. | |
| 7,416,338 | B2 | | 8/2008 | Ausnit | |
| 8,635,748 | B2 | | 1/2014 | Anzini | |
| 11,542,065 | B2 | | 1/2023 | Todaka | |
| 2004/0252915 | A1 | | 12/2004 | Nelson | |
| 2005/0281491 | A1 | * | 12/2005 | Ausnit | B65D 33/2508 24/399 |
| 2008/0232722 | A1 | * | 9/2008 | Pawloski | B65D 33/01 383/63 |
| 2010/0011545 | A1 | * | 1/2010 | Anzini | B65D 33/2588 24/427 |
| 2013/0248541 | A1 | * | 9/2013 | Verma | B65D 33/00 29/428 |

OTHER PUBLICATIONS

International Preliminary Report on Patentability dated Mar. 2, 2023 for corresponding application No. PCT/US2021/046402 (9 pages).

* cited by examiner

HINGED ZIPPER ASSEMBLY OF A RESEALABLE ENCLOSURE

CROSS-REFERENCE TO RELATED APPLICATIONS

This application claims priority to U.S. Provisional Application No. 63/067,608, which was filed on 19 Aug. 2020, and the entire disclosure of which is incorporated herein by reference.

BACKGROUND

Technical Field

The subject matter described herein relates to zipper assemblies of resealable enclosures, such as bags, pouches, or the like, that can be repeatedly opened and closed using interlocking members of the zipper assemblies.

Discussion of Art

Resealable enclosures are used to store a variety of materials. For example, pouches, bags, or the like, can be used to store food, pharmaceuticals, or other consumer products and may include resealable closure assemblies. These closure assemblies can include interlocking members that can be pressed together to close them (by moving a slider along the interlocking members to force the members together, by manually pressing the members toward each other, or the like).

Some resealable enclosures are used to store materials that are not safe for children. For example, pharmaceuticals may be stored or provided in resealable enclosures and may require child-resistant or child-deterrent features that prevent or increase the difficulty in children opening the enclosures.

BRIEF DESCRIPTION

A method for forming a hinged zipper assembly also is provided herein. The method includes forming first and second zipper members, with each of the zipper members formed with an elongated body having a facing side, an opposite side, an upper edge, and an opposite lower edge. Each of the first and second zipper members are formed to have a profile protrusion that extends from the facing sides and are located between the upper and lower edges. The profile protrusions of the first and second zipper members are shaped to mesh with each other to interlock the first and second zipper members with each other. The method also includes forming a living hinge in one or more of the first zipper member or the second zipper member between the lower edge and the profile protrusion of the one or more of the first zipper member or the second zipper member. The first and second zipper members are formed with flanges that extend from the lower edges. The flanges are configured to be affixed to panels of an enclosure that is closed by meshing of the profile protrusions of the first and second zipper members with each other. The living hinge can be formed by cutting a slit from the facing side of the elongated body toward the opposite side of the elongated body of the one or more of the first zipper member or the second zipper member.

In one embodiment, a zipper assembly includes first and second zipper members each having an elongated body with a facing side, an opposite side, an upper edge, and an opposite lower edge. The facing sides of the first and second zipper members face each other. The first and second zipper members each has a profile protrusion that extends from the facing sides and are located between the upper and lower edges. The profile protrusions of the first and second zipper members are shaped to mesh with each other to interlock the first and second zipper members with each other. The first and second zipper members each has flanges that extend from the lower edges. The flanges are configured to be affixed to panels of an enclosure that is closed by meshing of the profile protrusions of the first and second zipper members with each other. One or more of the first zipper member or the second zipper member includes a living hinge disposed between the lower edge and the profile protrusion of the one or more of the first zipper member or the second zipper member.

In one embodiment, a method includes forming first and second zipper members with each of the first and second zipper members formed with an elongated body having a facing side, an opposite side, an upper edge, and an opposite lower edge. Each of the first and second zipper members is formed to have a profile protrusion that extends from the facing sides and are located between the upper and lower edges. The profile protrusions of the first and second zipper members are shaped to mesh with each other to interlock the first and second zipper members with each other. The method also includes forming a living hinge in one or more of the first zipper member or the second zipper member between the lower edge and the profile protrusion of the one or more of the first zipper member or the second zipper member. The first and second zipper members are formed with flanges that extend from the lower edges. The flanges are configured to be affixed to panels of an enclosure that is closed by meshing of the profile protrusions of the first and second zipper members with each other.

In one embodiment, a flexible enclosure includes a first panel of a web material and a first zipper member having a first flange that is coupled with the first panel. The first zipper member has a first elongated body with a first facing side, a first opposite side, a first upper edge, and a first opposite lower edge. The first facing side includes a first profile protrusion. The enclosure also includes second panel of the web material facing the first panel to at least partially define an interior volume, and a second zipper member having a second flange that is coupled with the second panel. The second zipper member has a second elongated body with a second facing side, a second opposite side, a second upper edge, and a second opposite lower edge. The second facing side has a second profile protrusion shaped to mesh with the first profile protrusion of the first facing side of the first zipper member. One or more of the first zipper member or the second zipper member includes a living hinge disposed between one or more of (a) the first lower edge or the second lower edge and (b) the first profile protrusion or the second profile protrusion.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
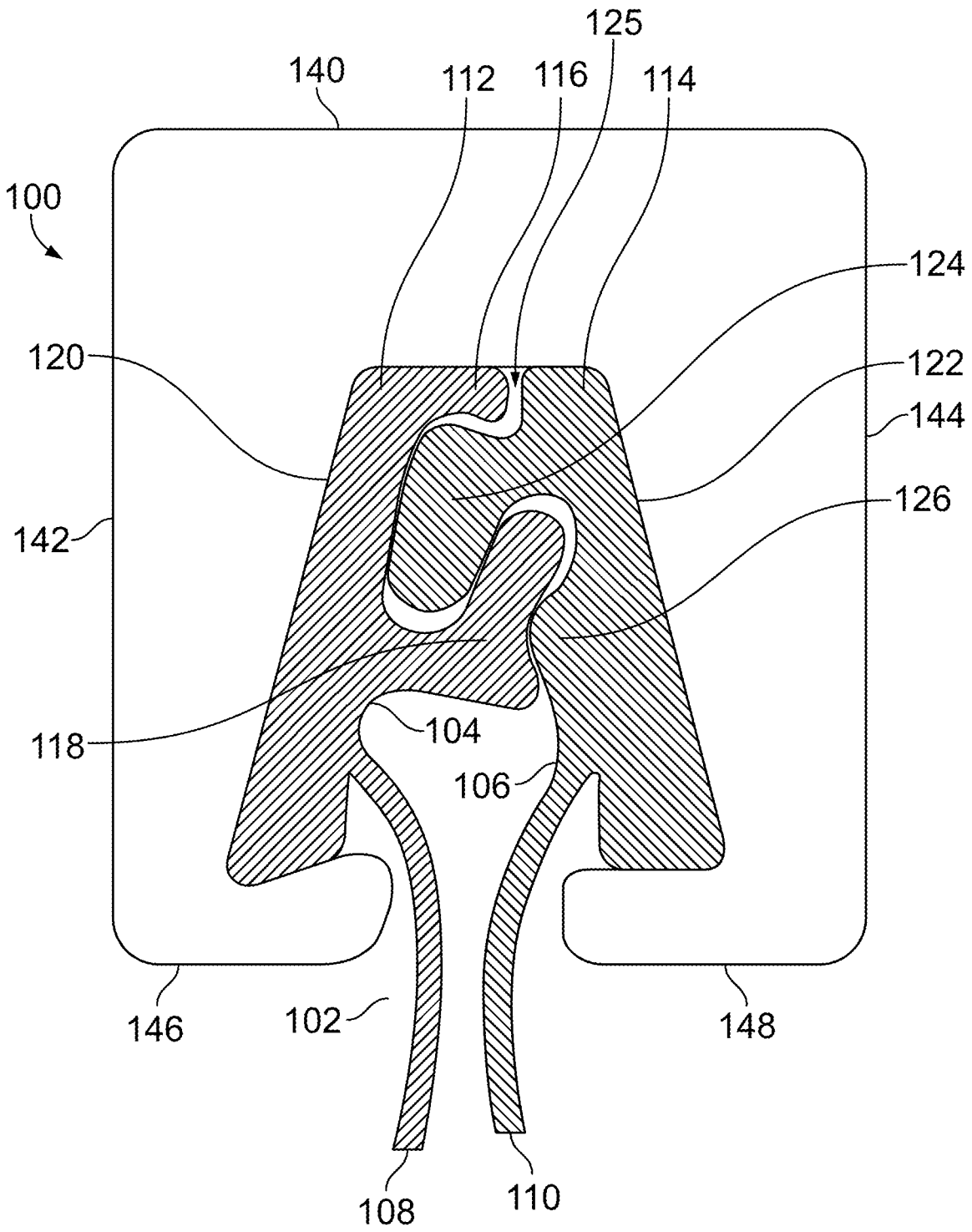
FIG. 1 illustrates one example of a slider mounted on a hinged zipper assembly.

FIG. 1 illustrates one example of a slider 100 mounted on a zipper assembly 102 having interlocking first and second zipper profile members 104, 106. The profile members 104, 106 include respective first and second flanges 108, 110 and respective first and second interlocking elements 112, 114. The first interlocking element 112 includes first and second arms 116, 118 that form a female configuration or female interlocking zipper member. The second interlocking element 114 includes a third arm 124 and a fulcrum 126 forming a male configuration or male interlocking zipper member. The male zipper member is received and meshes with the female zipper member of the first interlocking element 112. The slider 100 includes a top wall 140 and first and second sidewalls 142, 144 which terminate in respective first and second inwardly oriented lips 146, 148. A closing end of the slider 100 includes interior sidewalls 120, 122 that are inclined (as shown in FIG. 1) while an opening end of the slider 100 includes interior sidewalls 120, 122 which are substantially parallel to each other (e.g., more parallel than angled to each other). To open the zipper assembly 102, the first and second profiles 104, 106 are separated by the lower part of the interior sidewalls 120, 122 pushing the lower portion of the first and second profiles 104, 106 together. This causes the first profile 104 to pivot about fulcrum 126, which causes the third arm 124 to pull away from the first and second arms 116, 118 so that the second profile 106 moves upwardly into a recess 125.

One or more embodiments of the inventive subject matter described herein include hinged zipper assemblies that prevent or interfere with attempts to open enclosures without using the slider 100. For example, children applying an opening force on the enclosure by pulling on the outer panels or surfaces of the enclosures may not be able to separate the zipper members 104, 106 to open the enclosure. Instead, the slider 100 may need to be used to separate the zipper members 104, 106 and open the enclosure. The zipper assemblies include hinges, such as living hinges and/or simulated hinges, that reduce the moment over which the opening force is applied. This can reduce the force so that the force is inadequate to separate the zipper members from each other and open the enclosure.

Figure 2:
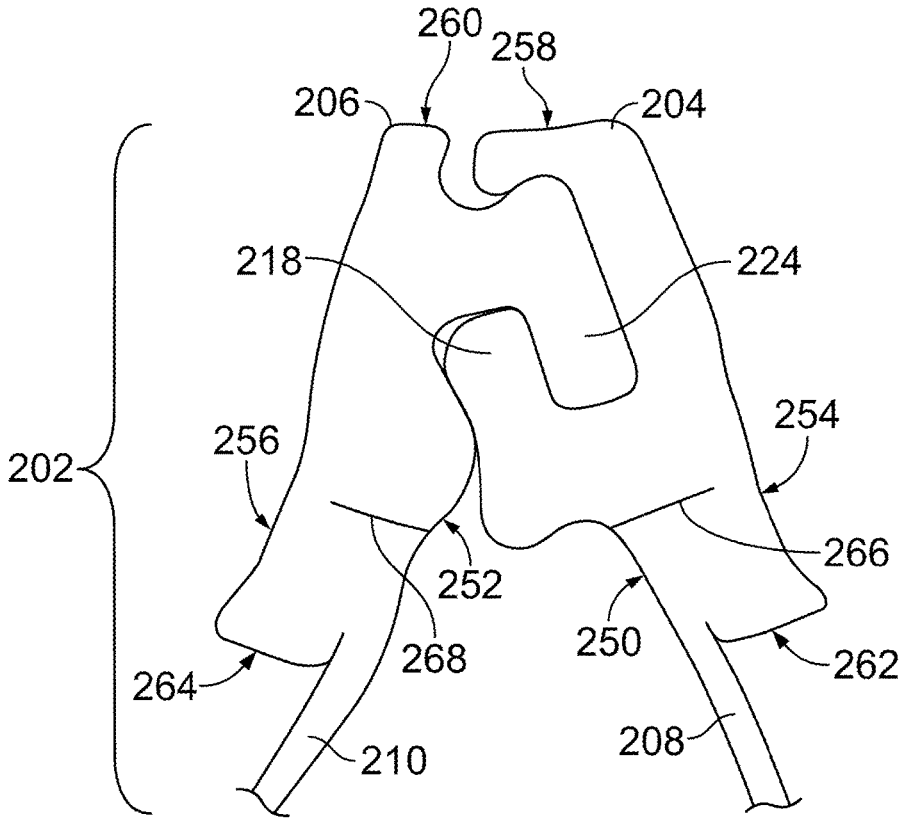
FIG. 2 illustrates one example of the hinged zipper assembly shown in FIG. 1.
Figure 3:
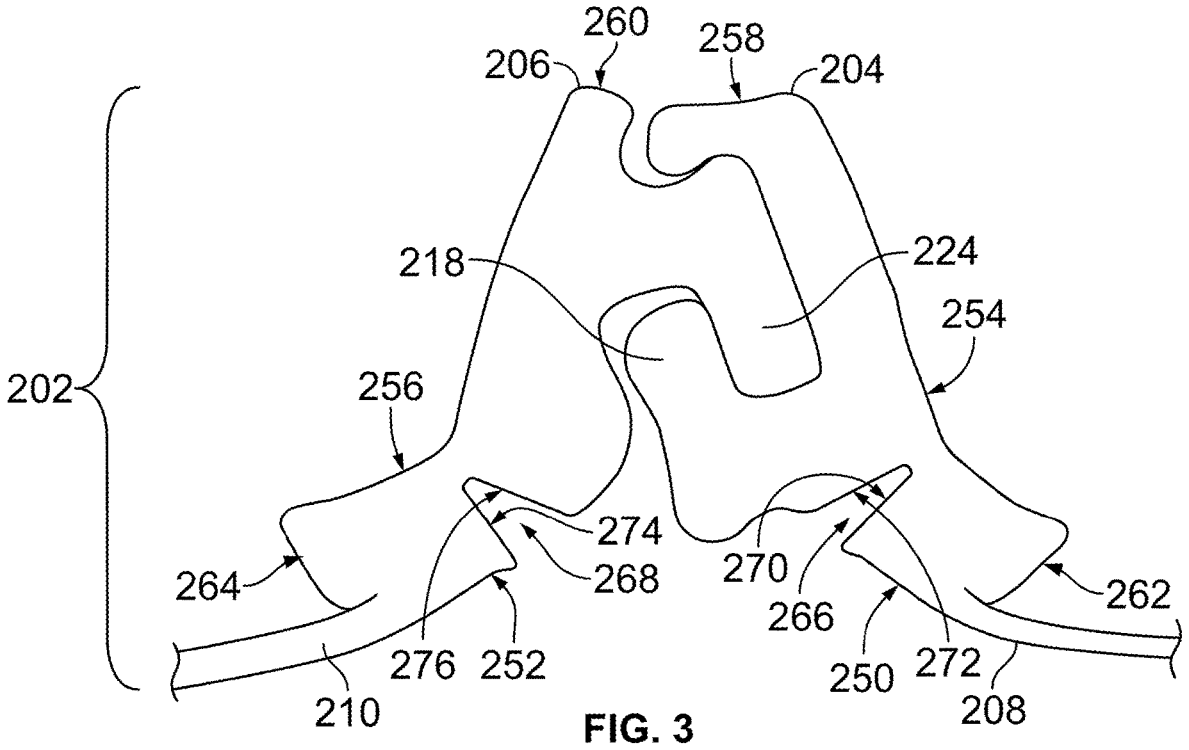
FIG. 3 illustrates the hinged zipper assembly shown in FIG. 2.

FIGS. 2 and 3 illustrate one example of a hinged zipper assembly 202. The zipper assembly 202 can be used in place of the zipper assembly 102 shown in FIG. 1 to provide a re-closeable and/or resealable closure for an enclosure such as a bag, pouch, or other container. The zipper assembly 202 includes interlocking first and second zipper profile members 204, 206 that are female and male interlocking members, similar to as described above in connection with the female and male interlocking members 104, 106. The zipper members 204, 206 each has an elongated body in directions extending into and out of the plane of FIG. 2. Each of the female and male zipper members 204, 206 includes a respective facing side 250, 252 and a respective opposite side 254, 256 (opposite to the facing side of each interlocking member). The interlocking members 204, 206 include respective upper edges 258, 260 and respective opposite lower edges 262, 264. The facing sides 250, 252 of the female and male zipper members 204, 206 can be the outermost surfaces of the zipper members 204, 206 and may face each other when the zipper members 204, 206 are separated from each other.

The zipper members 204, 206 have profile protrusions 218, 224 that can represent the arms 118, 124, described above. These profile protrusions 218, 224 extend from the respective facing sides 250, 252. The profile protrusion or second arm 218 of the female zipper member 204 is located between the upper edge 258 and the lower edge 262 of the female zipper member 204. The profile protrusion or third arm 224 of the male zipper member 206 is located between the upper edge 260 and the lower edge 264 of the male zipper member 206. As shown and described above, the profile protrusions 218, 224 are shaped to mesh with each other to interlock the first and second zipper members 204, 206 with each other.

The zipper members 204, 206 also include flanges 208, 210 that extend from the lower edges 262, 264. The flanges 208, 210 can represent the flanges 108, 110 shown in FIG. 1. The flanges 208, 210 can be affixed (e.g., sealed) to panels of an enclosure that is closed by meshing of the profile protrusions 218, 224 of the zipper members 204, 206 with each other.

At least one of the zipper members described in the various examples herein can have a living hinge. While the illustrated embodiments show both zipper members having a living hinge, optionally, only one of the zipper members may have a living hinge.

In the example shown in FIGS. 2 and 3, the zipper members 204, 206 include living hinges 266, 268 disposed between the lower edge 262, 264 and the profile protrusion 218, 224 of the zipper member 204, 206. The living hinge 266, 268 can be a linear slit or slot inwardly extending into the body of the zipper member 204, 206 from the facing side 250, 252 toward, but not all the way to, the opposite side 254, 256. For example, the living hinge 266 can be an elongated slit (elongated in directions extending into and out of the plane of FIG. 2) that extends from the facing side 250 of the female member 204 more than halfway through (but not entirely through) the distance from the facing side 250 to the opposite, rear side 254. The living hinge 268 can be an elongated slit (elongated in directions extending into and out of the plane of FIG. 2) that extends from the facing side 252 of the male member 206 more than halfway through (but not entirely through) the distance from the facing side 252 to the opposite, rear side 256.

The living hinges 266, 268 are linear slits formed between opposing interior surfaces of the zipper members 204, 206. For example, as shown in FIG. 3, the living hinge 266 in the female zipper member 204 is formed between opposing interior surfaces 270, 272 that contact each other along the entirety of the hinge 266 when the hinge 266 is closed (FIG. 2) and that separate from each other when the hinge 266 is activated or pulled apart (FIG. 3). Also as shown in FIG. 3, the living hinge 268 in the male zipper member 206 is formed between opposing interior surfaces 274, 276 that contact each other along the entirety of the hinge 268 when the hinge 268 is closed (FIG. 2) and that separate from each other when the hinge 268 is activated or pulled apart (FIG. 3).

In operation, the living hinges 266, 268 can prevent the enclosure to which the zipper members 204, 206 are joined from being opened by pulling on the panels or flanges 208, 210 of the zipper members 204, 206. A child or other person may attempt to open the zipper assembly 202 by pulling on the panels of the enclosure to which the zipper assembly 202 is joined. Pulling these panels causes the flanges 208, 210 of the zipper members 204, 206 to be pulled away from each other, as shown in FIG. 3. The living hinges 266, 268 prevent the pulling on the panels of the enclosure and on the flanges 208, 210 from separating the zipper members 204, 206 from each other. The living hinges 266, 268 reduce the moment applied to the protrusions 218, 224 by pulling on the flanges 208, 210. For example, without the hinges 266, 268, the moment applied to the protrusions 218, 224 would be the product of (a) an opening force applied to pull the panels or flanges 208, 210 apart and (b) the distance from where this force is applied to the protrusions 218, 224. With the hinges 266, 268, however, this moment is reduced to the product of (c) the opening force applied to the panels or flanges 208, 210 and (d) the shorter distance from the locations of the hinges 266, 268 to the protrusions 218, 224. By reducing the distance over which the opening force is applied, the protrusions 218, 224 may not separate (or may only separate with a force that destroys the panels, flanges 208, 210, and/or zipper members 204, 206), or may not separate with a force that a child can physically apply. This can make an enclosure that includes the zipper members 204, 206 with child resistance or child deterrence (to opening).

Figure 5:
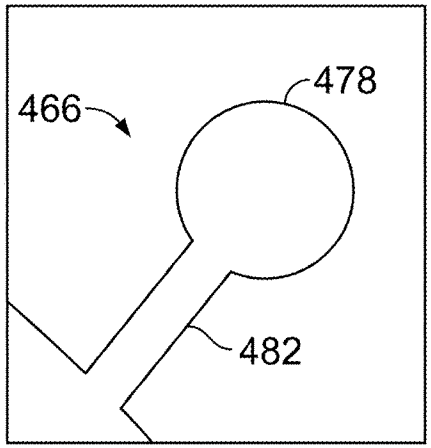
FIG. 5 illustrates a void hinge in FIG. 4 in a normal state.
Figure 6:
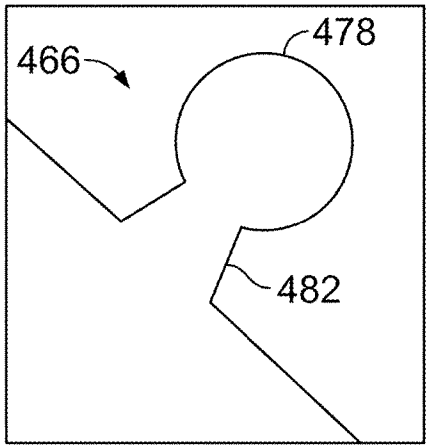
FIG. 6 illustrates the void hinge in FIG. 4 in a pulled state.
Figure 4:
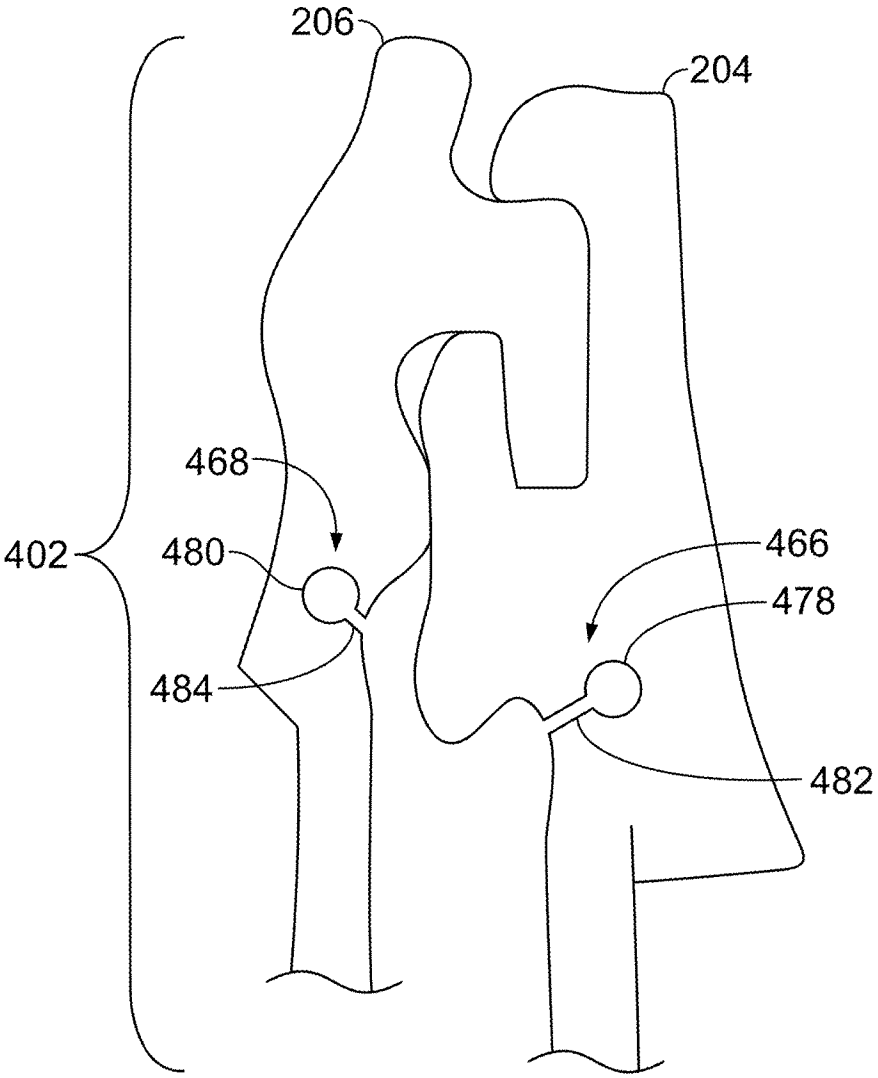
FIG. 4 illustrates another example of the hinged zipper assembly shown in FIG. 1.
Figure 7:
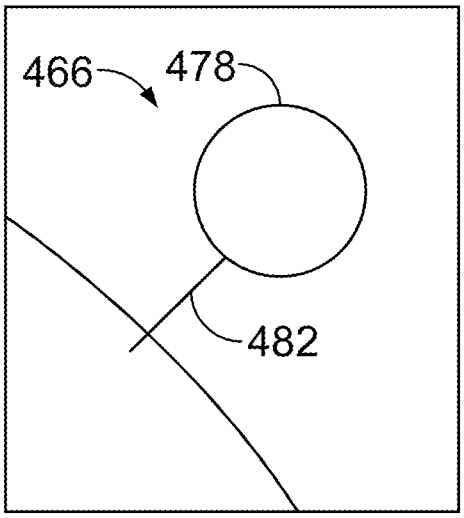
FIG. 7 illustrates the void hinge in FIG. 4 in a compressed state.

FIGS. 4 through 7 illustrate another example of a hinged zipper assembly 402. The zipper assembly 402 can be used in place of the zipper assembly 102 shown in FIG. 1 to provide a re-closeable and/or resealable enclosure. The zipper assembly 402 includes the interlocking zipper profile members 204, 206 described above. One difference between the zipper assemblies 202, 402 is the shape of living hinges. The living hinges 266, 268 are linear slits between opposing interior surfaces 270/272, 274/276. In contrast, the zipper assembly 402 includes living hinges 466, 468 that are formed from linear slits 482, 484 that extend to open voids 478, 480 within the bodies of the interlocking members 404, 406. The voids 478, 480 are circular in shape in FIGS. 4 through 7, but optionally can have another shape, such as a shape of an oval or other rounded body or the shape of a polygon. FIG. 5 illustrates the hinge 466 when no force is applied to pull the flanges 208, 210 apart, FIG. 6 illustrates the hinge 466 when force is applied to pull the flanges 208, 210 apart, and FIG. 7 illustrates the hinge 466 when force is applied to press the bottom side 262 and the top side 258 of the interlocking member 204 together. As described above, the hinges 466, 468 can reduce the distance over which the opening force is applied to the zipper members 204, 206 to prevent inadvertent opening of an enclosure, to prevent a child from opening an enclosure, etc.

The presence of the voids 478, 480 can reduce stress imparted on portions of the interlocking members 404, 406 located between the hinges and the back sides of the interlocking members. For example, the slit hinges 266, 268 may impart significant force on the thin portions of the bodies of the interlocking members 204, 206 located between the hinges 266, 268 and the sides 254, 256 of the members 204, 206. This force can tear through these portions of the bodies of the interlocking members 204, 206 and destroy the zipper assembly 202. In contrast, the voids 478, 480 in the void hinges 466, 468 can reduce the force applied to the portions of the bodies of the interlocking members 404, 406 between the hinges 466, 468 and the sides 254, 256 of the interlocking members 404, 406. The voids 478, 480 can spread out this force along or across a greater surface area (e.g., the surface area of the interlocking members 406, 408 within the voids 478, 480) to prevent tearing through the interlocking members 404, 406.

Figure 8:
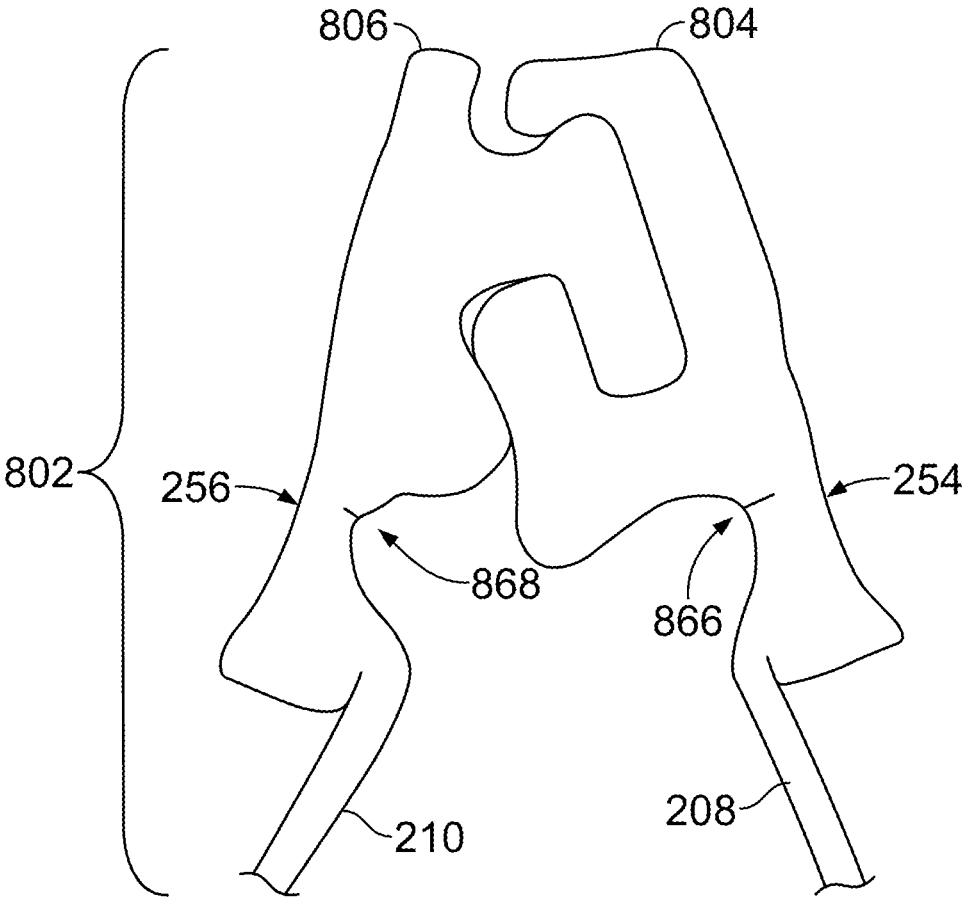
FIG. 8 illustrates one example of the hinged zipper assembly shown in FIG. 1.
Figure 9:
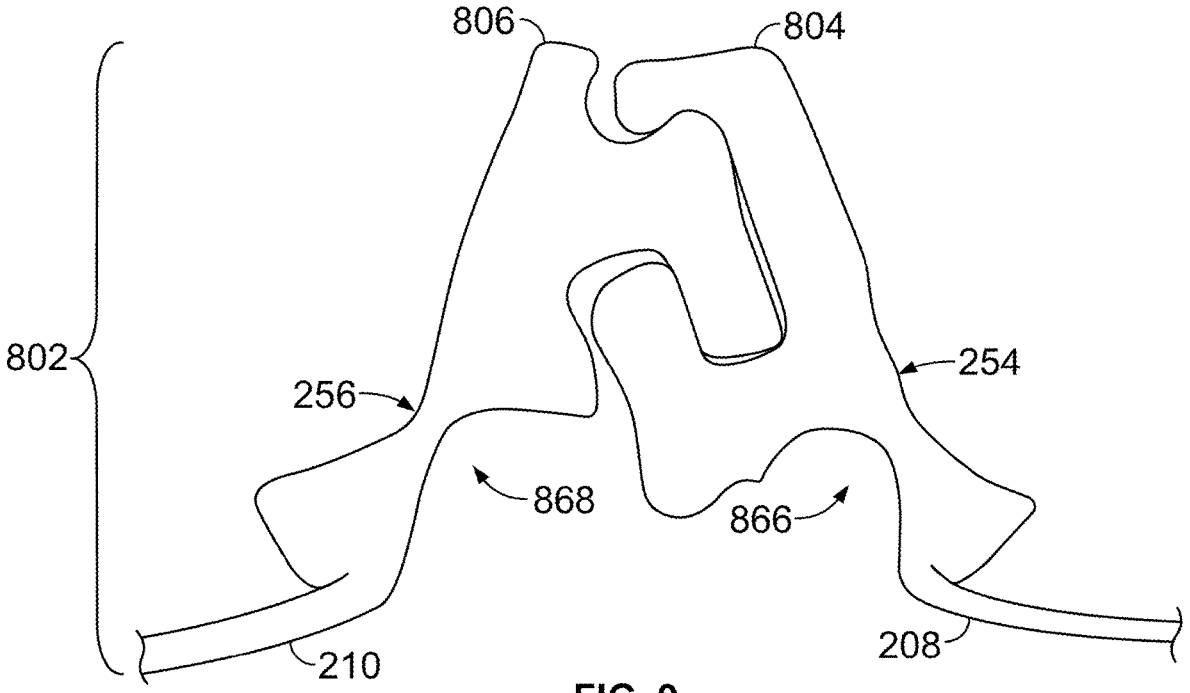
FIG. 9 illustrates the hinged zipper assembly shown in FIG. 8.

FIGS. 8 and 9 illustrate another example of a hinged zipper assembly 802. The zipper assembly 802 can be used in place of the zipper assembly 102 shown in FIG. 1 to provide a re-closeable and/or resealable enclosure. The zipper assembly 802 includes interlocking zipper profile members 804, 806 having similar shapes, edges, surfaces, etc., as the zipper members 204, 206 described above. One difference between the zipper assemblies 202, 802 is the shape of living hinges. The living hinges 266, 268 are linear slits between opposing interior surfaces 270/272, 274/276.

In contrast, the zipper assembly 802 includes living hinges 866, 868 that are formed from concave recesses extending inward from the facing sides 250, 252 of the zipper members 804, 806 toward the opposite sides 254, 256 of the zipper members 804, 806. The concave recesses forming the living hinges 866, 868 have arch shapes, such as shapes of semi-circles, semi-ovals, or portions of other rounded shapes. As described above, the hinges 866, 868 can reduce the distance over which the opening force is applied to the zipper members 804, 806 to prevent inadvertent opening of an enclosure, to prevent a child from opening an enclosure, etc. FIG. 8 illustrates the zipper members 804, 806 with no opening force applied while FIG. 9 illustrates the zipper members 804, 806 with an opening force applied to the panels and/or flanges 208, 210.

Similar to the void hinges 466, 468, the arch hinges 866, 868 can reduce stress imparted on portions of the interlocking members 804, 806 located between the hinges and the back sides 254, 256 of the interlocking members 804, 806. The arch hinges 866, 868 can reduce the force applied to the portions of the bodies of the interlocking members 804, 806 between the hinges 866, 868 and the sides 254, 256 of the interlocking members 804, 806 by spreading out this force along or across a greater surface area to prevent tearing through the interlocking members 804, 806.

Figure 10:
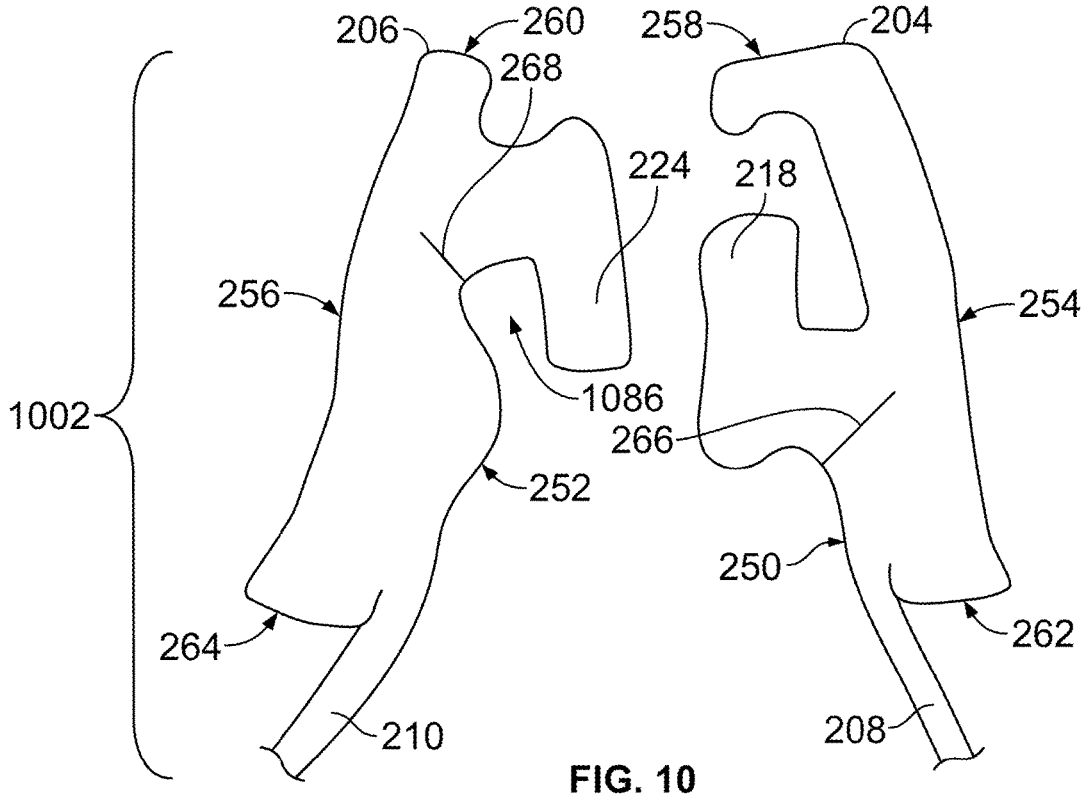
FIG. 10 illustrates one example of the hinged zipper assembly shown in FIG. 1.

FIG. 10 illustrates another example of a hinged zipper assembly 1002. The zipper assembly 1002 can be used in place of the zipper assembly 102 shown in FIG. 1 to provide a re-closeable and/or resealable enclosure. The zipper assembly 1002 includes the interlocking zipper profile members 204, 206 described above. One difference between the zipper assemblies 202, 1002 is the location of the living hinges 266, 268. In the zipper assembly 202, the living hinges 266, 268 are located closer to the bottom edges or sides 262, 264 than the upper edges or sides 258, 260. In the zipper assembly 1002, the living hinge 268 in the male zipper member 206 is located closer to the upper edge or side 260 than the lower edge or side 264. For example, the protrusion or arm 224 of the male zipper member 206 extends outward and downward to form a recess 1086 into which the protrusion or arm 218 of the female zipper member 204 is received. The hinge 268 in the male zipper member 206 can extend into the male zipper member 206 from inside the recess 1086 toward (but not entirely to) the back side 256 of the male zipper member 206. As described above, the hinges 266, 268 can reduce the moment generated by the opening force to prevent a child or other inadvertent opening of an enclosure by pulling on the panels or flanges 208, 210 of the zipper assembly 1002.

Another difference between the zipper assemblies 202, 1002 is the orientation of the living hinges 266, 268. In the zipper assembly 202, the slits forming the living hinges 266, 268 are oriented perpendicular to (or substantially perpendicular, such as between 85 degrees and 95 degrees to) the back sides 254, 256 of the zipper members 204, 206. But, in the zipper assembly 1002, the slits forming the living hinges 266, 268 are oriented toward the upper sides 258, 260 of the zipper members 204, 206. For example, the slits may be angled upward toward the upper sides 258, 260 such that the slits are not oriented perpendicular to the back sides 254, 256 of the zipper members 204, 206. Angling the slits upward can further reduce the amount of force transferred to the zipper members 204, 206 due to the opening force applied to the panels and/or flanges 208, 210. For example, the angled slits can further shorten the moment of force applied to the zipper members 204, 206 by shortening the distance over which the opening force is applied to the zipper members 204, 206. Optionally, the hinges 266, 268 are both disposed beneath the protrusions 218, 224 (as shown in FIG. 2), but with the hinges 266, 268 oriented upward as the hinge 266 is oriented in FIG. 10.

Figure 11:
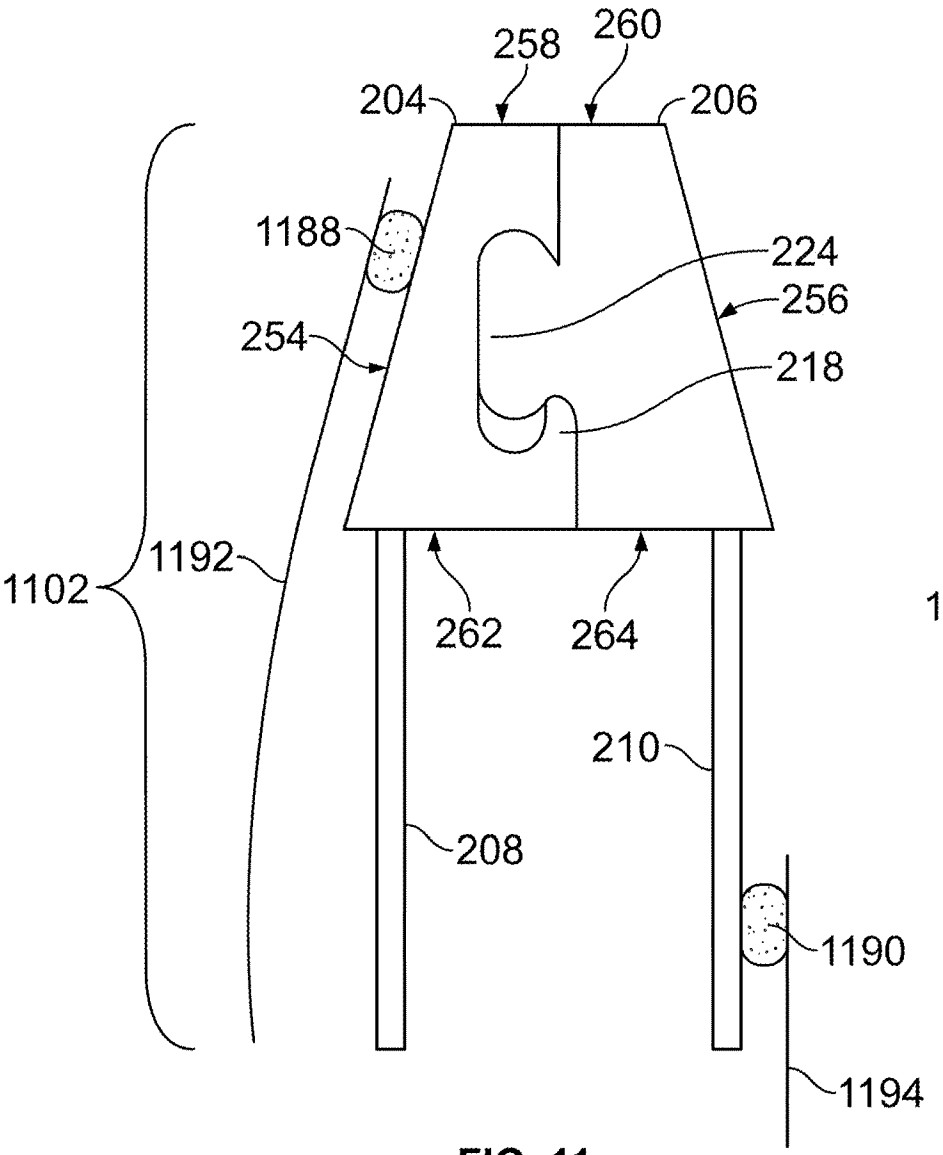
FIG. 11 illustrates one example of a simulated hinge zipper assembly.

FIG. 11 illustrates another example of a hinged zipper assembly 1102. The zipper assembly 1102 can be used in place of the zipper assembly 102 shown in FIG. 1 to provide a re-closeable and/or resealable enclosure. The zipper assembly 1102 includes the interlocking zipper profile members 204, 206 described above, but without the living hinges 266, 268. Instead, the zipper assembly 1102 includes a simulated living hinge that is created by different connection points 1188, 1190 between panels 1192, 1194 of an enclosure and the flanges and the zipper members. For example, neither the zipper member 204 nor the zipper member 206 in the assembly 1102 may include a living hinge formed by a slit, arch, void, or the like.

In the zipper assemblies 102, 202, 402, 802, 1002, the flanges 208, 210 may be sealed (e.g., heat sealed) to the panels 1192, 1194 (not visible in FIGS. 1 through 10) in locations below the lower sides or edges 262, 264. In the zipper assembly 1102, one of the flanges 208 or 210 can be coupled with the panel 1192 or 1194 below the lower side 262 or 264, while the other of the flanges 210 or 208 is not coupled with the other panel 1194 or 1192. Instead, the other panel 1194 or 1192 is coupled with the back side 256 or 254 closer to the upper side 260 or 258. In the illustrated example, the panel 1194 is joined to the flange 210 of the male zipper member 206 by a heat seal at the connection point 1190 below the lower side 264 of the male zipper member 206 and the panel 1192 is sealed to the back side 254 of the female zipper member 204 by a heat seal at the connection point 1188. Alternatively, the panel 1194 can be sealed to the back side 256 of the male zipper member 206 and the panel 1192 can be sealed to the flange 208 of the female zipper member 204 below the bottom side 262 of the female zipper member 204.

Coupling the panels 1192, 1194 to the zipper members 204, 206 in different locations that are different distances from the upper sides 258, 260 creates a hinge that reduces the force applied to separate the zipper members 204, 206 when the panels 1192, 1194 are pulled apart by the opening force. For example, pulling the panels 1192, 1194 away from each other can cause the opening force to rotate the zipper assembly 1102 (e.g., in a counter-clockwise direction in FIG. 11) instead of pulling the zipper members 204, 206 apart from each other. The slider 100 may pass over the seal at the connection point 1188 during opening and closing of the zipper assembly 1102.

Figure 12:
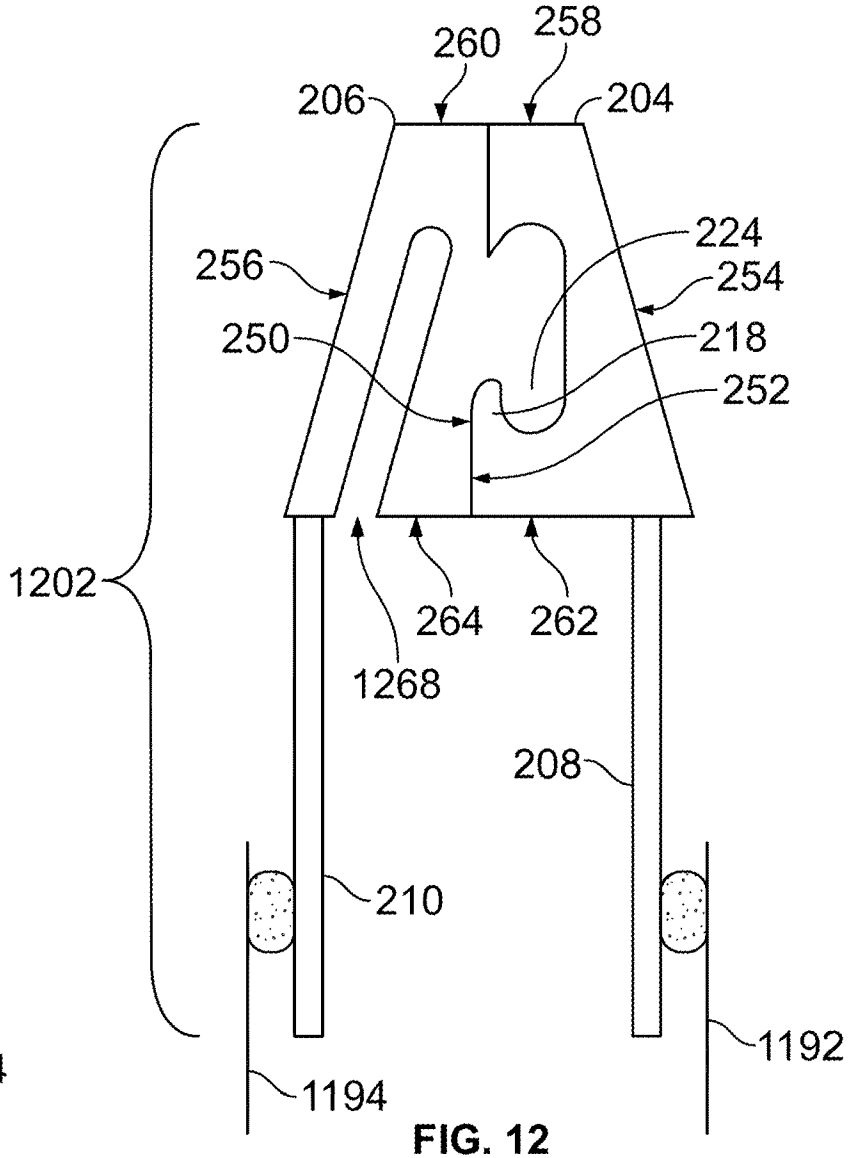
FIG. 12 illustrates one example of the hinged zipper assembly shown in FIG. 1.

FIG. 12 illustrates another example of a hinged zipper assembly 1202. The zipper assembly 1202 can be used in place of the zipper assembly 102 shown in FIG. 1 to provide a re-closeable and/or resealable enclosure. The zipper assembly 1202 includes the interlocking zipper profile members 204, 206 described above, but with at least one of the zipper members 204 or 206 having a vertical hinge 1268. The vertical hinge 1268 is formed in the male zipper member 206 in the illustrated embodiment, but optionally can also be in the female zipper member 204 or may only be in the female zipper member 204. The vertical hinge 1268 can be a slit or a slot that extends from the lower side 264 toward, but not entirely to, the upper side 260 of the male zipper member 206 between the opposite sides 252, 256. Optionally, the vertical hinge 1268 can be a slit or a slot that extends from the lower side 262 toward, but not entirely to, the upper side 258 of the female zipper member 204 between the opposite sides 250, 254. As shown, the panels 1192, 1194 of the enclosure can be sealed to the flanges 208, 210 below the zipper assembly 1202.

If the opening force is applied to the panels 1192, 1194 by pulling the panels 1192, 1194 apart, the force can cause the hinge 1268 to open such that the back side 256 of the zipper member 206 moves away from the front side 252 of the zipper member 206. This shortens the moment over which the opening force is applied to the zipper members 204, 206 and can prevent the zipper members 204, 206 from separating.

Figure 13:
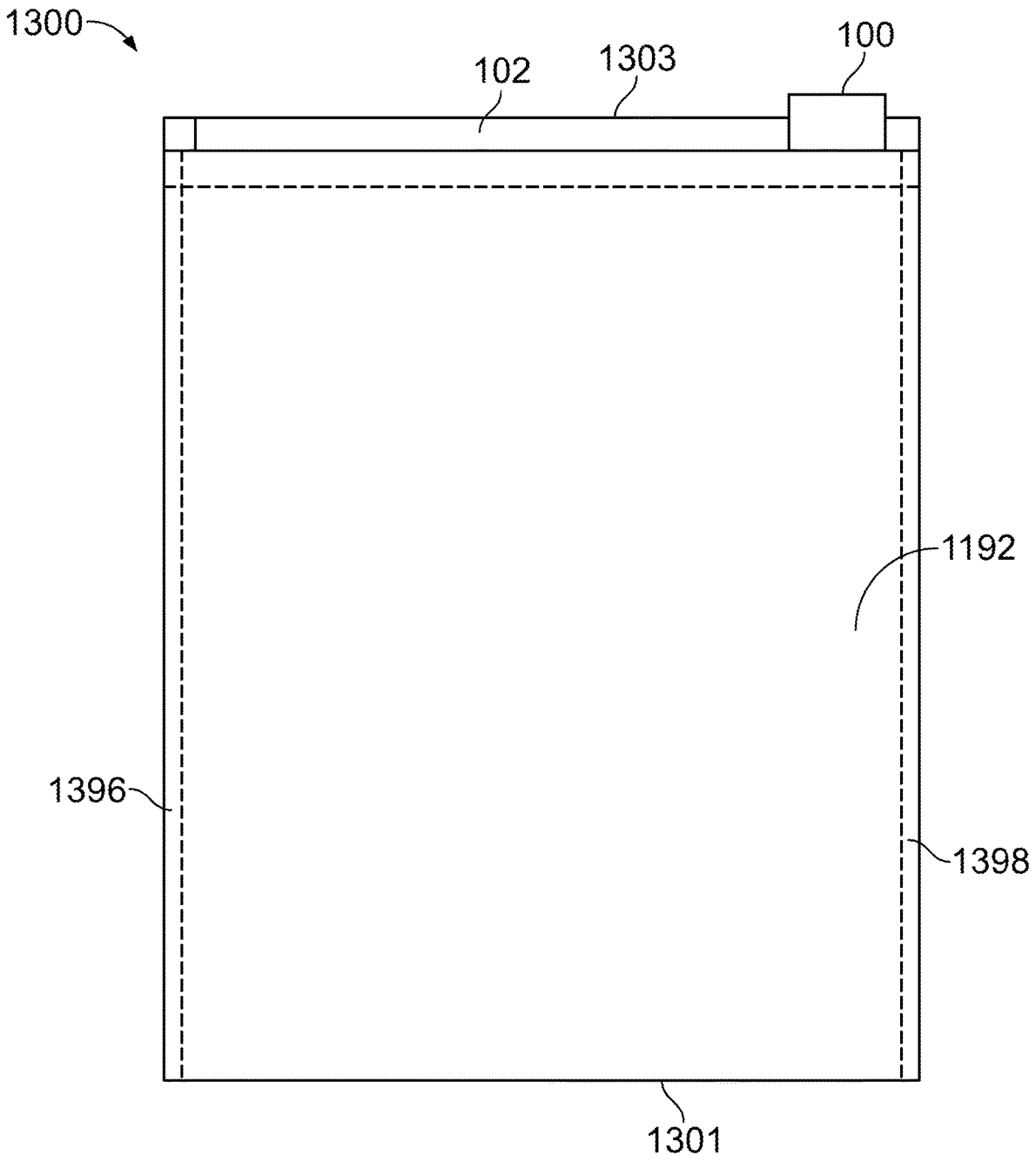
FIG. 13 illustrates one example of a flexible enclosure that includes the zipper assembly shown in FIG. 1.

FIG. 13 illustrates one example of an enclosure 1300 having the hinged zipper assembly 102. The enclosure 1300 is formed from one or more webs of flexible material (e.g., a polymer). These webs form the one or more of the panels 1192, 1194 that are joined or otherwise closed along opposing edges 1396, 1398 and a bottom edge 1301 of the enclosure 1300. For example, if the enclosure 1300 is formed from multiple webs of material as the panels 1192, 1194, then the panels 1192, 1194 may be sealed to each other along the edges 1396, 1398, 1301 to enclose or bound an interior chamber or volume. If the enclosure 1300 is formed from a single web (e.g., a tube of the web material), then the tube of web material can be sealed along one of the edges 1396, 1398, or 1301 to enclose or bound the interior chamber or volume (and may include a fin or lap seal running vertically on one of the faces or panels). The panels 1192, 1194 can be different portions of this single web on opposite sides of the interior chamber or volume. The panel 1192 is shown in FIG. 13 with the panel 1194 located behind the panel 1192 (on the opposite side of the enclosure 1300).

The zipper assembly 102 can be disposed along upper edges 1303 of the panels 1192, 1194, such as by heat sealing the zipper assembly 102 to the upper edges 1303 of the panels 1192, 1194. The zipper assembly 102 can include the slider 100 that is used to open the zipper assembly 102 to provide access into the enclosure 1300 and that is used to close the zipper assembly 102 to prevent access into the enclosure 1300. As described herein, the hinged zipper assembly 102 can prevent the zipper members from being separated to access the interior of the enclosure 1300 by pulling the panels 1192, 1194 apart from each other.

Figure 14:
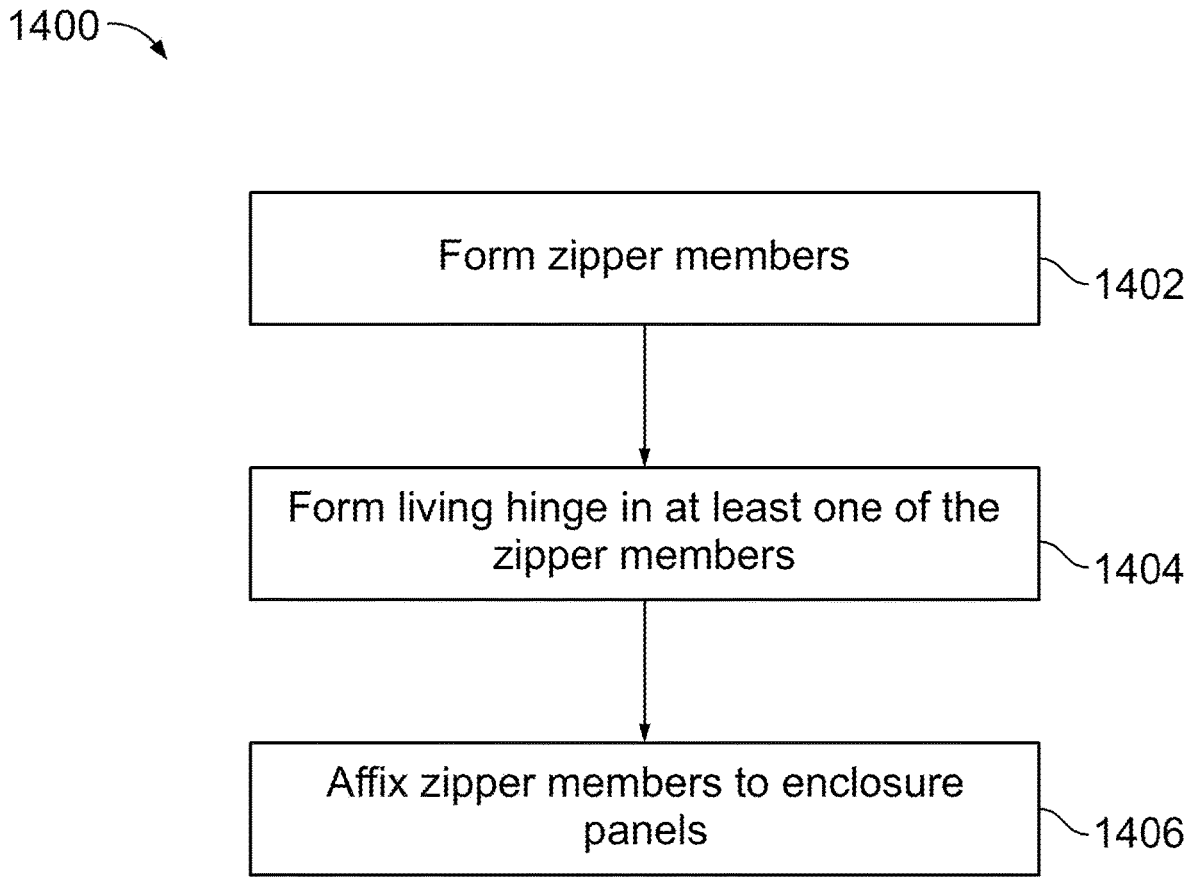
FIG. 14 illustrates a flowchart of one example of a method for creating and attaching a hinged zipper assembly to an enclosure.

FIG. 14 illustrates a flowchart of one example of a method 1400 for creating a hinged zipper assembly and connecting the assembly to an enclosure. The method 1400 includes forming first and second zipper members at 1402. Each of the zipper members can be formed with an elongated body having a facing side, an opposite side, an upper edge, and an opposite lower edge. Each of the first and second zipper members can be formed to have a profile protrusion that extends from the facing sides and are located between the upper and lower edges. The profile protrusions of the first and second zipper members are shaped to mesh with each other to interlock the first and second zipper members with each other. The method 1400 also can include forming a living hinge in one or more of the first zipper member or the second zipper member between the lower edge and the profile protrusion of the one or more of the first zipper member or the second zipper member at 1404. The living hinge can be formed by cutting a slit from the facing side of the elongated body toward the opposite side of the elongated body of the one or more of the first zipper member or the second zipper member. Optionally, the living hinge is formed by extruding the elongated body of the first zipper member and/or the second zipper member to include the slit, the slit and a void, or a concave recess. The first and second zipper members can be formed with flanges that extend from the lower edges. At 1406, the flanges are affixed to panels of an enclosure that is closed by meshing of the profile protrusions of the first and second zipper members with each other. The method optionally also can include sealing a first panel with the opposite side of the elongated body of the first zipper member between the upper edge and the lower edge of the elongated body of the first zipper member, and sealing a second panel with the flange of the second zipper member below the lower edge of the elongated body of the second zipper member.

In one embodiment, a zipper assembly includes first and second zipper members each having an elongated body with a facing side, an opposite side, an upper edge, and an opposite lower edge. The facing sides of the first and second zipper members face each other. The first and second zipper members each has a profile protrusion that extends from the facing sides and are located between the upper and lower edges. The profile protrusions of the first and second zipper members are shaped to mesh with each other to interlock the first and second zipper members with each other. The first and second zipper members each has flanges that extend from the lower edges. The flanges are configured to be affixed to panels of an enclosure that is closed by meshing of the profile protrusions of the first and second zipper members with each other. One or more of the first zipper member or the second zipper member includes a living hinge disposed between the lower edge and the profile protrusion of the one or more of the first zipper member or the second zipper member.

Optionally, the living hinge is formed by a slit extending from the facing side of the elongated body toward the opposite side of the elongated body of the one or more of the first zipper member or the second zipper member.

Optionally, the living hinge is formed by the slit that extends from the facing side of the elongated body to an open void within the elongated body of the one or more of the first zipper member or the second zipper member.

Optionally, the living hinge is formed by a concave recess extending from the facing side of the elongated body toward the opposite side of the elongated body of the one or more of the first zipper member or the second zipper member.

Optionally, the concave recess forming the living hinge has an arch shape.

Optionally, the living hinge is formed by a slit extending into the lower edge toward the upper edge of the elongated body of the one or more of the first zipper member or the second zipper member.

Optionally, the assembly also can include first and second panels of the panels, with the first panel coupled with the opposite side of the elongated body of the first zipper member and the second panel coupled with the flange of the second zipper member. The living hinge can be formed by the first panel being coupled with the opposite side of the elongated body of the first zipper member between the upper edge and the lower edge of the elongated body of the first zipper member and by the second panel coupled with the flange of the second zipper member below the lower edge of the elongated body of the second zipper member.

Optionally, the profile protrusion of the first zipper member has a bent shape and the profile protrusion of the second zipper member has a receptacle shaped to receive the bent shape of the profile protrusion of the first zipper member.

Optionally, both the first zipper member and the second zipper portion have the living hinge with the living hinge in the first zipper member disposed closer to the upper edge of the first zipper member than the living hinge in the second zipper member.

Optionally, the living hinge is disposed in the first zipper member as a linear slit oriented at a transverse angle relative to the facing side and the upper edge of the first zipper member.

Optionally, the assembly also can include a slider having opposite first and second ends and opposite first and second sidewalls that each extend from the first end to the second end. The slider can have a space between the first and second sidewalls, where the space has a shape through which the first and second zipper members move. In an absence of an additional manual force to push the first and second sidewalls of the slider toward each other, the first and second sidewalls provide an insufficient force to separate the first and second zipper members from each other and the additional manual force must be provided to the first and second sidewalls to pivot the first zipper member about a fulcrum on the second zipper member to separate the first zipper member from the second zipper member. The second end of the slider having elements for interlocking the profile protrusions of the first zipper member and the second zipper member in response to motion of the slider along the first zipper member and the second zipper member in a closing direction. The slider can be formed of a flexible material that is configured to be manually pressed to urge the first and second sidewalls of the slider together to separate the profile protrusions of the first zipper member and the second zipper member.

In one embodiment, a method includes forming first and second zipper members with each of the first and second zipper members formed with an elongated body having a facing side, an opposite side, an upper edge, and an opposite lower edge. Each of the first and second zipper members is formed to have a profile protrusion that extends from the facing sides and are located between the upper and lower edges. The profile protrusions of the first and second zipper members are shaped to mesh with each other to interlock the first and second zipper members with each other. The method also includes forming a living hinge in one or more of the first zipper member or the second zipper member between the lower edge and the profile protrusion of the one or more of the first zipper member or the second zipper member. The first and second zipper members are formed with flanges that extend from the lower edges. The flanges are configured to be affixed to panels of an enclosure that is closed by meshing of the profile protrusions of the first and second zipper members with each other.

Optionally, the living hinge is formed by cutting a slit from the facing side of the elongated body toward the opposite side of the elongated body of the one or more of the first zipper member or the second zipper member.

Optionally, the living hinge is formed by extruding the elongated body of the one or more of the first zipper member or the second zipper member to include the slit to extend from the facing side of the elongated body to an open void within the elongated body.

Optionally, the living hinge is formed by extruding the elongated body of the one or more of the first zipper member or the second zipper member to include a concave recess extending from the facing side of the elongated body toward the opposite side of the elongated body.

Optionally, the concave recess forming the living hinge has an arch shape.

Optionally, the living hinge is formed by cutting a slit into the lower edge toward the upper edge of the elongated body of the one or more of the first zipper member or the second zipper member.

Optionally, the method also can include sealing a first panel of the panels with the opposite side of the elongated body of the first zipper member between the upper edge and the lower edge of the elongated body of the first zipper member, and sealing a second panel of the panels with the flange of the second zipper member below the lower edge of the elongated body of the second zipper member.

Optionally, the profile protrusion of the first zipper member is formed to have a bent shape and the profile protrusion of the second zipper member is formed to have a receptacle shaped to receive the bent shape of the profile protrusion of the first zipper member.

In one embodiment, a flexible enclosure includes a first panel of a web material and a first zipper member having a first flange that is coupled with the first panel. The first zipper member has a first elongated body with a first facing side, a first opposite side, a first upper edge, and a first opposite lower edge. The first facing side includes a first profile protrusion. The enclosure also includes second panel of the web material facing the first panel to at least partially define an interior volume, and a second zipper member having a second flange that is coupled with the second panel. The second zipper member has a second elongated body with a second facing side, a second opposite side, a second upper edge, and a second opposite lower edge. The second facing side has a second profile protrusion shaped to mesh with the first profile protrusion of the first facing side of the first zipper member. One or more of the first zipper member or the second zipper member includes a living hinge disposed between one or more of (a) the first lower edge or the second lower edge and (b) the first profile protrusion or the second profile protrusion.

Optionally, the living hinge is formed by a slit.

Optionally, the living hinge is formed by the slit that extends to an open void.

Optionally, the living hinge is formed by an arch-shaped concave recess.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A zipper assembly comprising:

first and second zipper members each having an elongated body with a facing side, an opposite side, an upper edge, and an opposite lower edge, the facing sides of the first and second zipper members facing each other, the first and second zipper members each having a profile protrusion that extends from the facing sides and are located between the upper and lower edges, the profile protrusions of the first and second zipper members shaped to mesh with each other to interlock the first and second zipper members with each other, the first and second zipper members each having flanges that extend from the lower edges, the flanges configured to be affixed to panels of an enclosure that is closed by meshing of the profile protrusions of the first and second zipper members with each other, wherein one or more of the first zipper member or the second zipper member includes a living hinge disposed between the lower edge and the profile protrusion of the one or more of the first zipper member or the second zipper member, the living hinge formed by a slit extending inwardly from the facing side toward the corresponding opposite side, the living hinge including interior surfaces opposing each other across the slit, the interior surfaces move relative to each other as the living hinge is opened and closed, the interior surfaces contacting each other while the living hinge is closed, the interior surfaces spaced apart from each other while the living hinge is open, wherein in response to the profile protrusions of the first and second zipper members being meshed with each other, the living hinge is configured to be closed, and wherein in response to an opening force being applied to pull the flanges apart when the profile protrusions of the first and second zipper members are meshed with each other, the living hinge is configured to be open while the profile protrusions of the first and second zipper members remain meshed with each other.

2. The zipper assembly of claim 1, wherein the slit extends from the facing side of the elongated body toward the opposite side of the elongated body of the one or more of the first zipper member or the second zipper member.

3. The zipper assembly of claim 1, wherein the living hinge is formed by the slit that extends from the facing side of the elongated body to an open void within the elongated body of the one or more of the first zipper member or the second zipper member.

4. The zipper assembly of claim 1, wherein the profile protrusion of the first zipper member has a bent shape and the profile protrusion of the second zipper member has a receptacle shaped to receive the bent shape of the profile protrusion of the first zipper member.

5. The zipper assembly of claim 4, wherein both the first zipper member and the second zipper member have the living hinge with the living hinge in the first zipper member disposed closer to the upper edge of the first zipper member than the living hinge in the second zipper member.

6. The zipper assembly of claim 4, wherein the slit is a linear slit oriented at a transverse angle relative to the facing side and the upper edge of the first zipper member.

7. The zipper assembly of claim 1, further comprising:

a slider having opposite first and second ends and opposite first and second sidewalls that each extend from the first end to the second end, the slider having a space between the first and second sidewalls, the space having a shape through which the first and second zipper members move, wherein, in an absence of an additional manual force to push the first and second sidewalls of the slider toward each other, the first and second sidewalls provide an insufficient force to separate the first and second zipper members from each other and the additional manual force must be provided to the first and second sidewalls to pivot the first zipper member about a fulcrum on the second zipper member to separate the first zipper member from the second zipper member, the second end of the slider having elements for interlocking the profile protrusions of the first zipper member and the second zipper member in response to motion of the slider along the first zipper member and the second zipper member in a closing direction, the slider formed of a flexible material that is configured to be manually pressed to urge the first and second sidewalls of the slider together to separate the profile protrusions of the first zipper member and the second zipper member.

8. A method comprising:

forming first and second zipper members, each of the first and second zipper members formed with an elongated body having a facing side, an opposite side, an upper edge, and an opposite lower edge, each of the first and second zipper members formed to have a profile protrusion that extends from the facing sides and are located between the upper and lower edges, the profile protrusions of the first and second zipper members shaped to mesh with each other to interlock the first and second zipper members with each other; and forming a living hinge in one or more of the first zipper member or the second zipper member between the lower edge and the profile protrusion of the one or more of the first zipper member or the second zipper member, the living hinge formed by a slit extending inwardly from the facing side toward the corresponding opposite side, the living hinge including interior surfaces opposing each other across the slit, the interior surfaces moving relative to each other to open and close the living hinge as the living hinge is opened and closed, the interior surfaces contacting each other while the living hinge is closed, the interior surfaces spaced apart from each other while the living hinge is open, wherein the first and second zipper members are formed with flanges that extend from the lower edges, the flanges configured to be affixed to panels of an enclosure that is closed by meshing of the profile protrusions of the first and second zipper members with each other, wherein in response to the profile protrusions of the first and second zipper members being meshed with each other, the living hinge is configured to be closed, and wherein in response to an opening force being applied to pull the flanges apart when the profile protrusions of the first and second zipper members are meshed with each other, the living hinge is configured to be open while the profile protrusions of the first and second zipper members remain meshed with each other.

9. The method of claim 8, wherein the living hinge is formed by cutting the slit from the facing side of the elongated body toward the opposite side of the elongated body of the one or more of the first zipper member or the second zipper member.

10. The method of claim 8, wherein the living hinge is formed by extruding the elongated body of the one or more of the first zipper member or the second zipper member to include the slit to extend from the facing side of the elongated body to an open void within the elongated body.

11. The method of claim 8, wherein the living hinge is formed by cutting the slit into the elongated body from the facing side and extending at an angle toward one of the lower edge or the upper edge of the elongated body of the one or more of the first zipper member or the second zipper member.

12. The method of claim 8, further comprising:

sealing a first panel of the panels with the opposite side of the elongated body of the first zipper member between the upper edge and the lower edge of the elongated body of the first zipper member; and sealing a second panel of the panels with the flange of the second zipper member below the lower edge of the elongated body of the second zipper member.

13. The method of claim 8, wherein the profile protrusion of the first zipper member is formed to have a bent shape and the profile protrusion of the second zipper member is formed to have a receptacle shaped to receive the bent shape of the profile protrusion of the first zipper member.

14. A flexible enclosure comprising:

a first panel of a web material;

a first zipper member having a first flange that is coupled with the first panel, the first zipper member having a first elongated body with a first facing side, a first opposite side, a first upper edge, and a first opposite lower edge, the first facing side including a first profile protrusion;

a second panel of the web material facing the first panel to at least partially define an interior volume; and a second zipper member having a second flange that is coupled with the second panel, the second zipper member having a second elongated body with a second facing side, a second opposite side, a second upper edge, and a second opposite lower edge, the second facing side having a second profile protrusion shaped to mesh with the first profile protrusion of the first facing side of the first zipper member, wherein the first zipper member includes a living hinge disposed between the first lower edge and the first profile protrusion, the living hinge formed by a slit extending inwardly from the first facing side toward the second opposite side, the slit having interior surfaces opposing each other across the slit, the interior surfaces moving relative to each other to open and close the slit as the living hinge is opened and closed, the interior surfaces contacting each other while the living hinge is closed, the interior surfaces spaced apart from each other while the living hinge is open, wherein in response to the profile protrusions of the first and second zipper members being meshed with each other, the living hinge is configured to be closed, and wherein in response to an opening force being applied to pull the flanges apart when the profile protrusions of the first and second zipper members are meshed with each other, the living hinge is configured to be open while the profile protrusions of the first and second zipper members remain meshed with each other.

* * * * *